United States Patent [19]

Schlage

[11] 4,073,172

[45] Feb. 14, 1978

[54] HIGH SECURITY DEADBOLT LOCK

[75] Inventor: Ernest L. Schlage, Burlingame, Calif.

[73] Assignee: Schlage Lock Company, San Francisco, Calif.

[21] Appl. No.: 693,191

[22] Filed: June 7, 1976

[51] Int. Cl.[2] ..... E05B 15/16

[52] U.S. Cl. ..... 70/417; 70/370

[58] Field of Search ..... 70/417, 370, 451, 416

[56] References Cited

U.S. PATENT DOCUMENTS

| | | | |
|---|---|---|---|
| Re. 16,123 | 7/1925 | Schonwald | 70/417 |
| 2,126,391 | 8/1938 | Jacobi | 70/417 |
| 3,083,563 | 4/1963 | Greenwald | 70/417 |
| 3,768,284 | 10/1973 | Kent | 70/417 X |
| 3,868,836 | 3/1975 | La Roche | 70/370 |

*Primary Examiner*—Robert L. Wolfe

*Attorney, Agent, or Firm*—Lothrop & West

[57] ABSTRACT

A high security lock has a protective shell with a hole in it. A lock body is held within the shell by an end plate having a loop around the body. A plug having an end flange is rotatable in the body and is pierced by a keyway defining an edge notch in the end flange. A guard plate is disposed in the hole and over the end of the plug and is arranged to rotate in the shell with the plug by a tab disposed in the edge notch so that a restricted opening through the guard plate is kept in alignment with the keyway.

3 Claims, 9 Drawing Figures

FIG-4
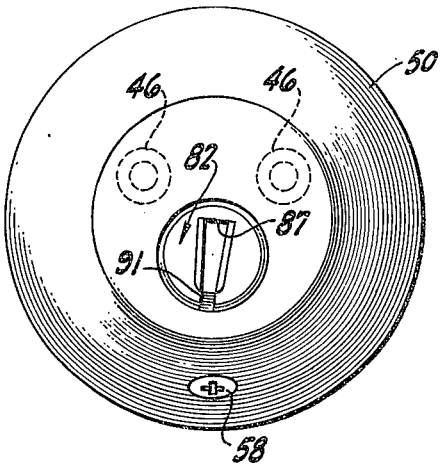
FIG-3
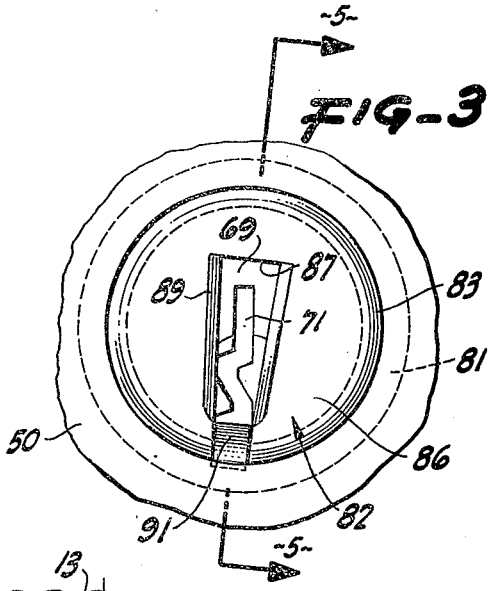
FIG-5
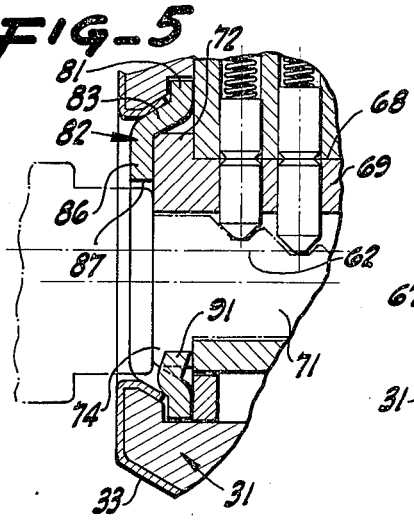
FIG-6
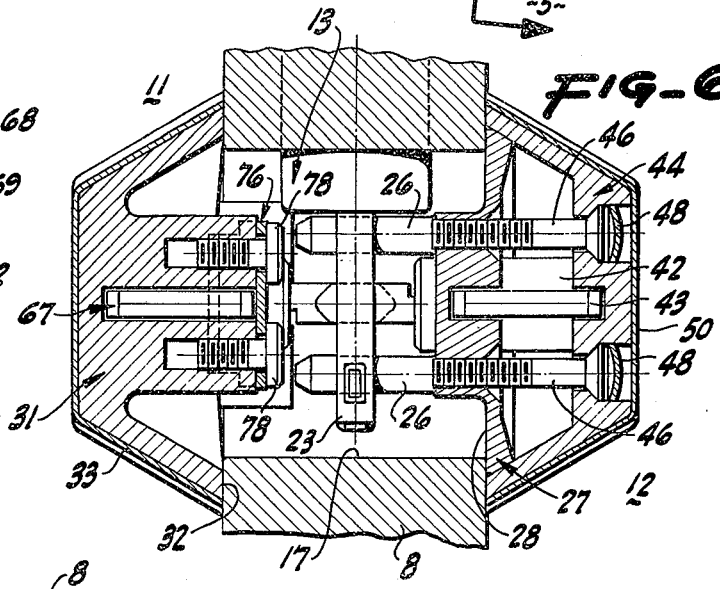
FIG-8
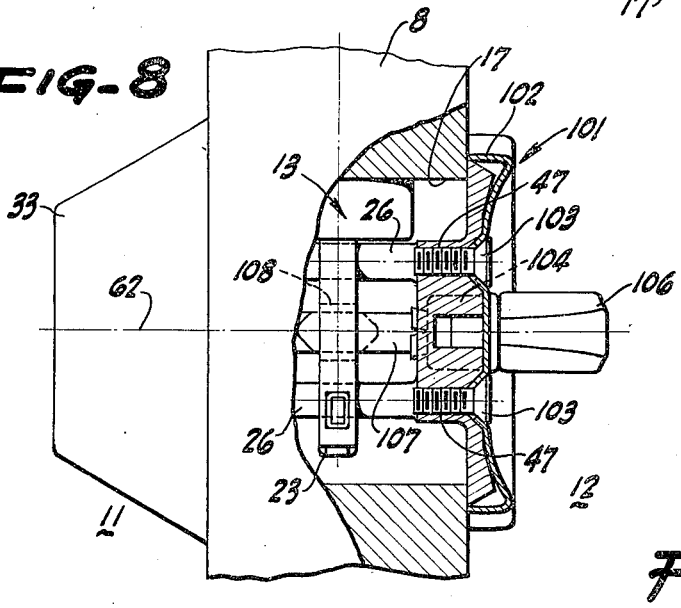
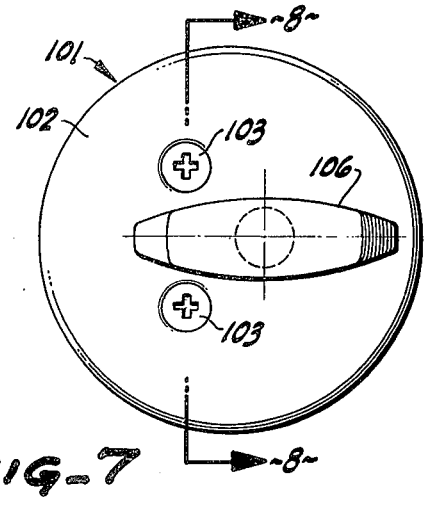
FIG-7

HIGH SECURITY DEADBOLT LOCK

BRIEF SUMMARY OF THE INVENTION

In order to preclude tampering with a lock, particularly a pin tumbler lock, there is provided a guard plate of resistant material that thwarts drilling into the tumbler portion of the lock in order to disrupt its locking power. The guard plate is rotated with the cylinder plug in order to maintain a restricted key opening in the guard plate in line with the plug keyway. There are means internally removable from the mechanism to maintain the lock cylinder mechanism and the guard plate in operating position.

BRIEF DESCRIPTION OF THE SEVERAL VIEWS OF THE DRAWING

FIG. 3 is an exterior elevation of the guard plate portion of the lock mechanism shown in FIG. 1.

FIG. 4 is an interior elevation of the guard plate portion of the mechanism of the invention.

FIG. 5 is a cross-section on the line 5—5 of FIG. 3, part of the structure being broken away to reduce the size of the figure.

FIG. 6 is a cross-section, the plane of section being indicated by the line 6—6 of FIG. 2.

FIG. 7 is an interior elevational view of a modification of the interior construction.

FIG. 8 is a cross-section, the planes of which are indicated by the line 8—8 of FIG. 7.

DETAILED DESCRIPTION

Figure 1:
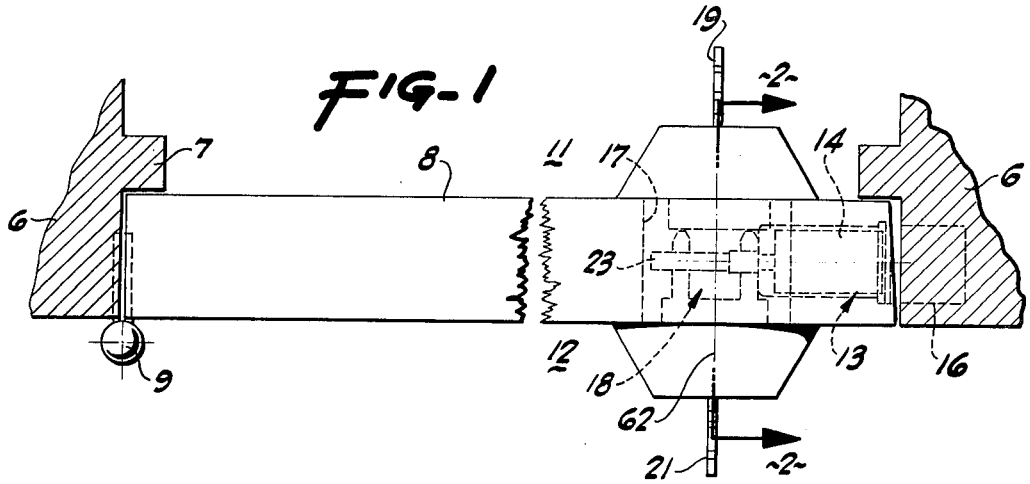
FIG. 1 is a view in horizontal cross-section through a door panel on which is mounted a high security deadbolt lock pursuant to the invention, portions being broken away.
Figure 9:
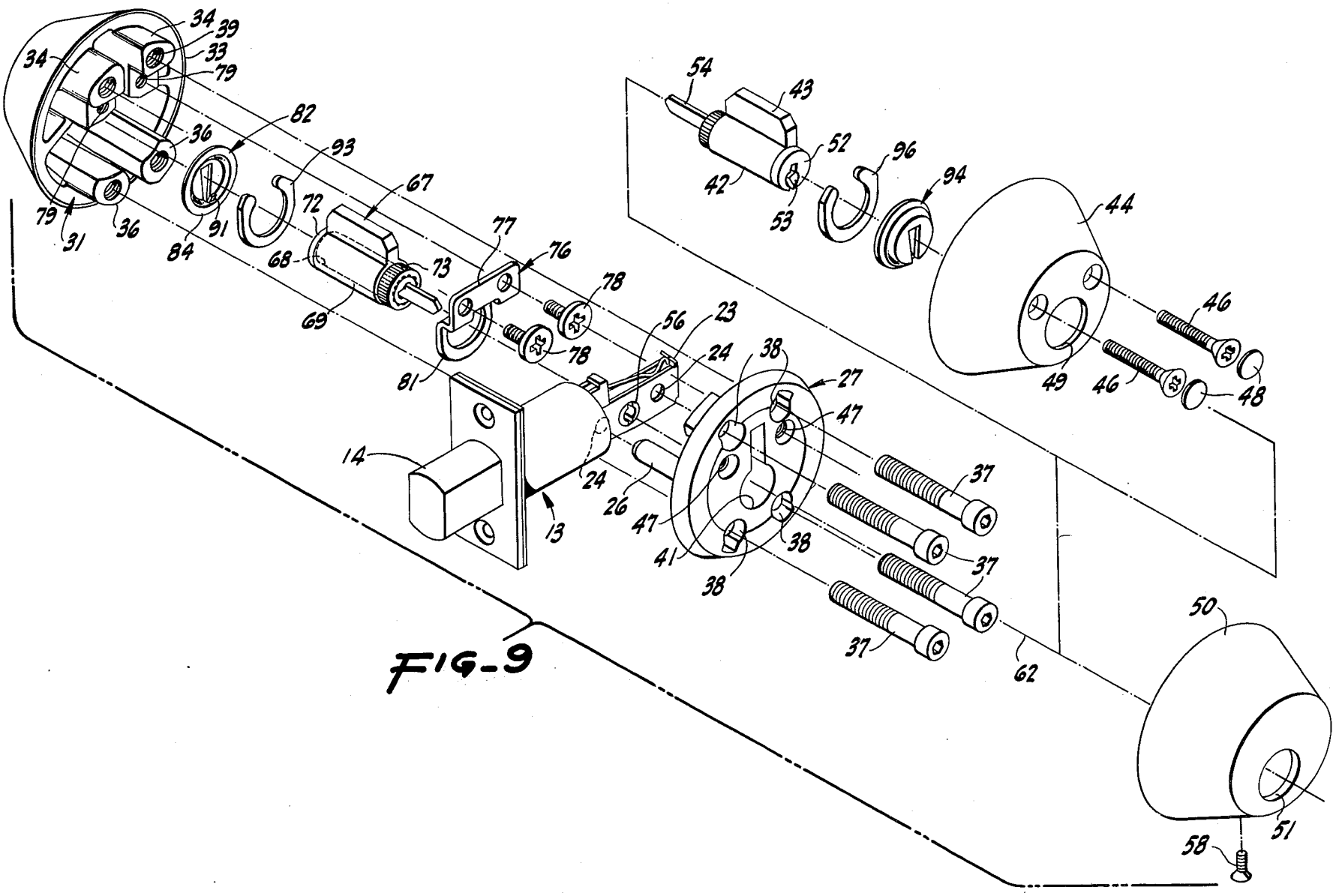
FIG. 9 is an exploded view in isometric projection showing various parts of the arrangement in their relative but spaced positions.

A normal environment for installation of the high security deadbolt lock is in connection with a wall 6 (FIG. 1) in which is disposed a door frame including a door stop 7. Mounted on the door frame is a door panel 8 swinging between open and closed positions about the axis of hinges 9. The door panel is between an arbitrarily indicated exterior side 11 of the wall and an interior side 12 thereof. On the door panel is a bolt mechanism 13 adapted to operate between a retracted position in which the panel 8 is free to swing and a projected position in which a bolt 14 (FIG. 9) is projected to interengage with a strike box 16 in the door frame or wall 6.

The door panel is provided with a through bore 17 in which a high security deadbolt lock 18 is mounted. In the present instance the lock mechanism is controllable by an exterior key 19 and by an interior key 21. The installations on opposite sides of the panel are shown as substantially duplicated, although the interior installation is sometimes varied, as will hereinafter appear.

Figure 2:
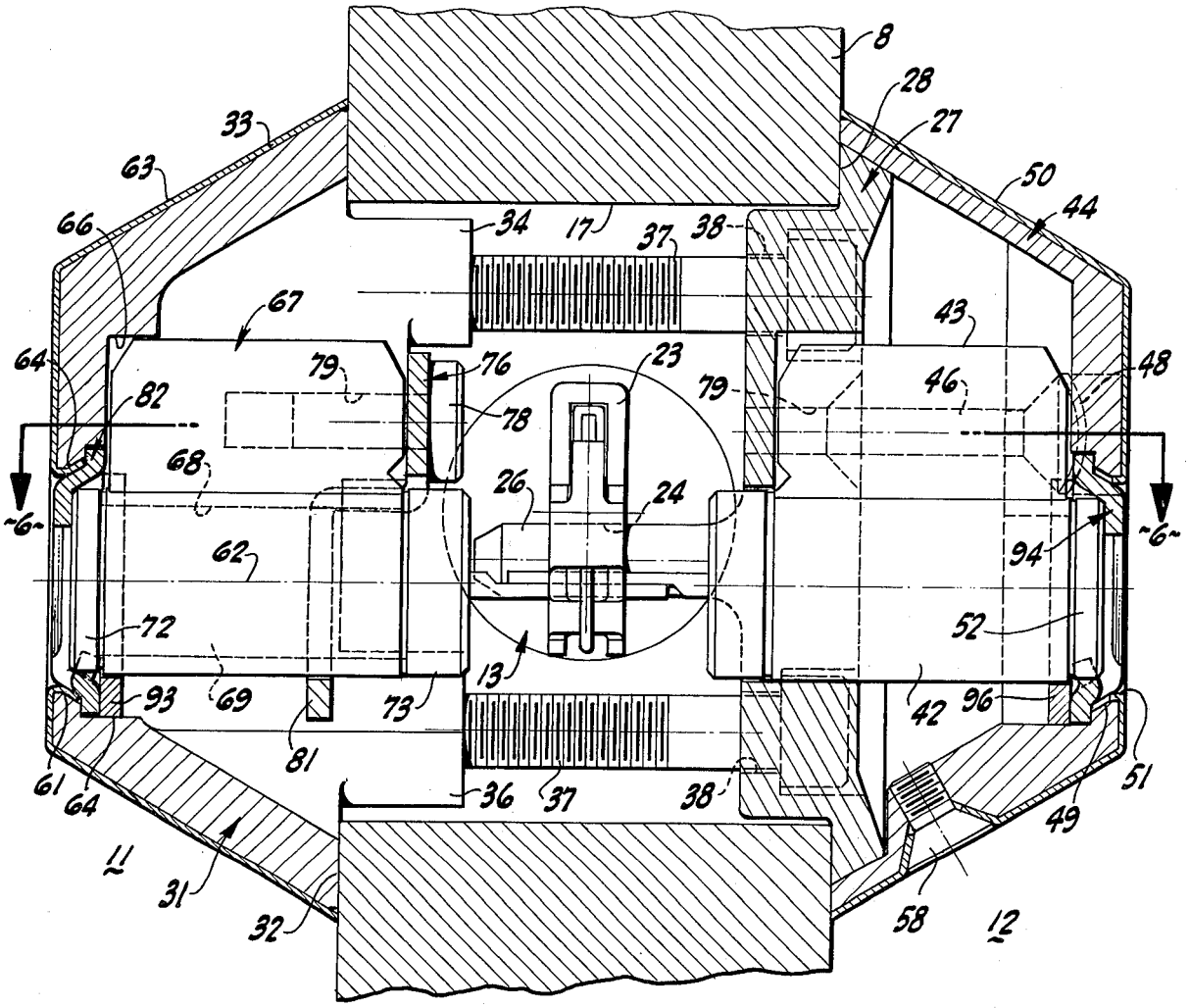
FIG. 2 is a cross-section, the plane of which is indicated by the line 2—2 of FIG. 1.

The bolt mechanism 13 includes a bolt frame 23 (FIGS. 2 and 9) having a pair of holes 24 therein and through which pass elongated posts 26 extending from an interior plate 27 having a generally conical periphery surrounding a face 28 adapted to abut against the interior surface of the door panel 8.

A somewhat similar but deeper conical exterior shell 31 is formed with an abutting face 32 to contact the exterior surface of the door panel. If desired, the shell is provided with a permanent skin or surface cup 33 of an ornamental nature. The shell 31 has a number of pairs of projecting bosses 34 and 36 having an envelope contour matching the bore 17 and positioned to receive fastening bolts 37, preferably with countersunk Allen heads, passing through appropriate apertures 38 in the plate 27 and engaging interior threads 39 in blind holes in the pairs of bosses 34 and 36. In this fashion the internal plate 27 and the aligned external shell 31 are pulled tightly toward each other and clamped on the door panel with the posts 26 passing through the apertures 24 and so holding the bolt mechanism 13 in appropriate position and alignment. Both the exterior shell and the interior plate are thus pulled tightly and firmly into engagement with the panel and against external dislodgment or removal.

The interior plate 27 is formed with a central, deep, keyhole-shaped recess and aperture 41 designed to accommodate a standard cylinder body 42 such as is customarily found in a key-operated, pin tumbler cylinder lock mechanism. The cylinder body 42 has a generally circular-cylindrical portion with a radially and axially extending rib or flag 43 thereon. The body 42 fits well within the keyhole-shaped aperture 41 and the flag in the recess so that the lock mechanism is thereby held against rotation within the plate 27.

The plate 27 and its accompanying mechanism are concealed behind a conical cover 44 secured in place by a pair of screws 46 passing through apertures in the cover and engaging suitably tapped holes 47 in the plate 27, the cover preferably also receiving Welch plugs 48 to conceal the heads of the screws 46 and making them generally unavailable after the initial installation has been made. The cover is recessed to receive and closely abut one end of the flag 43 and has a hole 49 to accommodate the body 42.

The cover 44 may be exposed or may carry a separate skin 50 or other decorative embellishment provided with a central opening 51 for the reception of the key 21 for operating a rotary plug 52 in the lock mechanism. The plug has the customary axially extending keyway 53 and is also joined by a driver bar 54 to the bolt actuating hub 56. When the shell 44 is provided with the decorative cover 50, the cover is held in place by a screw 58 engaging the shell 44. The Welch plugs can be dispensed with, if desired, as the mechanism is enclosed by the cover 50.

The exterior shell 31 is also of generally frusto-conical configuration and is provided with a circular hole 61 therein generally concentric with a through axis 62 for the assembly. If desired, the shell can have a decorative surface or skin 63 crimped inwardly on the margin of the hole 61 to retain the trim cover 63 in position. The interior of the shell 31 is provided with a counterbore 64 as well as a recess 66 so as snugly to receive a lock unit 67 of the customary kind, including a generally circular-cylindrical or tubular body and an upstanding or radial and axial flag or rib.

The lock body 67 has a through bore 68 in which a plug 69 is rotatable about the axis 62. The plug is formed with an irregularly shaped axially extending keyway 71 (FIG. 3) therethrough and is formed with a flange 72 at one end and carries a closure collar 73 at the other end. The closure collar passes a driver bar seated in the bolt actuator hub 56 in the usual way. The plug is rotatable within the body but is not axially displaceable. The plug and body mechanism are substantially standard in that the keyway 71 not only extends through the plug but likewise extends through the flange 72 and leaves an edge notch 74 in the plug flange.

The exterior lock mechanism is retained in the indicated position by a retainer 76 having a bridge 77 extending thereacross and designed to abut an end of the flag on the lock unit 67. The retainer 76 is held in place by fasteners 78 engaging tapped holes 79 in the outer shell 31. The retainer is extending to afford an offset loop 81 that generally surrounds and underlies the body 67 closely so that the lock mechanism is maintained in proper alignment along the axis 62. In this fashion the exterior lock mechanism is restrained against any axial translation and is also restrained against any lateral or tipping motion off the axis and with respect to the exterior shell.

Particularly pursuant to the invention, there is disposed within the hole 61 and in general alignment with the end of the plug 69 a guard plate 82 (FIG. 5). This is fabricated of extremely hard material so as to be virtually drill-proof. The guard plate has a frusto-conical portion 83 merging with a peripheral flange 84 designed to turn freely within the counterbore 64 of the hole 61. The frusto-conical portion 83 likewise merges with a planar front circle 86 normal to the axis 62. The circle substantially continues and is coplanar with the outer face of the exterior shell.

The guard plate 82 is particularly contoured to provide a generally trapezoidal opening 87 therethrough. The opening is made as small as possible in all dimensions. But the opening 87 is made large enough freely to admit through the opening any of a number of keys of different cross-sectional shape, whatever keys are designed to operate within differently configured keyways within the plug. The aim is to leave as little as possible of the relatively soft plug material exposed through the opening yet to afford easy access for any of the keys of the family of keys designed to operate in the corresponding one of the family of keyways. To assist in introduction of a key, the side boundaries 89 of the opening may be interiorly converging bevels.

The opening 87 extends nearly all the way to the peripheral flange 84 of the guard plate but is interrupted short thereof. From the opening emerges an integral tab 91 formed from the material of the guard plate and thus extremely difficult to penetrate. The tab merges with the guard plate near the periphery thereof. The tab is configured and bent so that it is moved out of the plane of the circle portion 86 of the guard plate into the general plane of the peripheral flange 84 thereof. The tab 91 is of an extent and configuration snugly and easily to fit within the edge notch 74 of the plug flange. The side walls of the tab make close contact with the side walls of the notch so that there is an interengagement or interkeying of the guard plate and the plug.

The guard plate is held axially for rotation within the exterior shell by a ring 93 having a slight springiness and pressed into the counterbore 64 in the exterior shell. While the guard plate is freely rotatable about the axis 62 it is not axially displaceable. When assembled the guard plate overlies and protects the otherwise exposed face of the plug including the flange of the plug.

A similar construction is provided in connection with the interior mechanism so that the flange end of the plug 52 is overlain by a guard plate 94, duplicating the guard plate 82 and similarly mounted in the interior cover 44 with a retaining ring 96 holding the guard plate in position.

The guard plates preclude the use of a drill of adequate size to cut axially into the end of the relatively soft metal plug either interiorly or exteriorly and so preclude interfering with the lock operation by such means.

While in this instance the door bolt is provided with key-operated mechanisms both interiorly and exteriorly and such mechanisms are both protected by guard plates, in some installations it is necessary only to protect the exterior installation. When that is the case, the interior, as shown in FIGS. 7 and 8, is alternatively supplied with a thumb turn structure 101. This includes a cover cup 102 snugly fitting over the interior plate 27 and held against that plate and in abutment with the interior surface of the door panel by fastenings 103. These replace the fastenings 46 but still are engageable in the tapped holes 47 in the plate 27. Rotatable in an appropriate hub 104 on the plate 102 is a cross bar 106 connected to a driver bar 107 replacing the driver bar 54 and interengaging with the bolt mechanism and overlapping the other driver bar in the bolt actuator hub 56.

Under these circumstances, when there is no interior key lock, the operation of the transverse thumb turn lever or bar 106 rotates the driver bar 107 and causes projection or retraction of the bolt 14. This latter installation is utilized when it is considered that there is no danger of tampering with the lock from the interior. In any instance wherein the lock mechanism is to be protected, whether on the interior or on the exterior, an arrangement incorporating the rotatable guard plate is provided. Interengagement of the tab 91 in the plug flange edge notch 74 allows ready key access to the plug keyway, but drilling and comparable access to the interior of the plug mechanism is inhibited.

Furthermore, since the plate flange 81 is within the counterbore 64 of the shell 31 and the guard plate 82 overlies the end of the plug 69, any tool engaging the plug, particularly in the keyway and used in an attempt to draw the plug out of the body by force, is ineffective as the plate 82 acts as a barrier to such motion.

While, as an example herein, a pin-tumbler, deadbolt lock has been shown and described, the arrangement for improved security can also be used with latch bolts, padlocks, wafer or lever locks and other arrangements in which a key-controlled security device is involved, and the claims herein should be read commensurately.

What is claimed is:

1. A high security lock for use with a door panel comprising a shell having a surface adapted to engage said panel and having a front wall, means defining a substantially circular hole through said front wall, an interior cylindrical counterbore in said front wall larger than said hole and concentric thereto, a lock body in said shell and having a planar end face and a circular-cylindrical bore therein concentric to said hole, a circular-cylindrical plug rotatable in said bore, a flange on one end of said plug abutting said end face and smaller than said hole to leave a space therebetween, means defining a keyway in said plug, said keyway having an edge opening radially through said flange to leave an edge notch therein, a circular guard plate larger than said hole rotatably mounted in said counterbore, said guard plate having a key-receiving opening therethrough and overlying said plug, a tab on said guard plate near the periphery thereof and disposed in said edge notch at the periphery of said flange, means mounting said lock body in said shell, and means separate from said body retaining said guard plate rotatably in said counterbore.

2. A device as in claim 1 including a loop in said shell supporting said plug in axial alignment with said hole, and restraining movement of said body axially away from said front wall.

3. A device as in claim 1 in which said guard plate partially telescopes over said plug end flange and bears on the wall of said counterbore.

* * * * *